US009518425B2

(12) United States Patent
Villar

(10) Patent No.: US 9,518,425 B2
(45) Date of Patent: Dec. 13, 2016

(54) LADDER CADDY ASSEMBLY

(71) Applicant: Eduardo Villar, Crete, IL (US)

(72) Inventor: Eduardo Villar, Crete, IL (US)

( * ) Notice: Subject to any disclaimer, the term of this patent is extended or adjusted under 35 U.S.C. 154(b) by 83 days.

(21) Appl. No.: 14/154,310

(22) Filed: Jan. 14, 2014

(65) Prior Publication Data

US 2016/0153235 A1 Jun. 2, 2016

(51) Int. Cl.
*B25H 3/00* (2006.01)
*E06C 7/14* (2006.01)

(52) U.S. Cl.
CPC ..... *E06C 7/14* (2013.01)

(58) Field of Classification Search
CPC ..... B25H 3/00; B25H 3/02; B25H 3/04; B25H 3/06
USPC ..... 206/443, 564, 565, 557, 373, 372
See application file for complete search history.

(56) References Cited

U.S. PATENT DOCUMENTS

| | | | | |
|---|---|---|---|---|
| 6,334,509 | B1 * | 1/2002 | Ryszkiewicz | E06C 7/14 182/129 |
| 6,766,881 | B2 * | 7/2004 | Carty | E06C 7/14 182/129 |
| 8,636,144 | B1 * | 1/2014 | Lawery | E06C 7/14 182/129 |
| 2002/0070136 | A1 * | 6/2002 | Hedges | B25H 3/00 206/373 |
| 2002/0092785 | A1 * | 7/2002 | Lungo | E06C 7/14 206/373 |
| 2009/0200189 | A1 * | 8/2009 | Fields | B25H 3/022 206/372 |

* cited by examiner

*Primary Examiner* — King M Chu
(74) *Attorney, Agent, or Firm* — Rockman, Videbeck & O'Connor, LLC; Howard B. Rockman

(57) ABSTRACT

A tool caddy assembly to be removably positioned over the top of a folding ladder including a housing having a bottom surface to hold items while the ladder is being used and a bracket to mount the caddy assembly to the ladder. An outer support wall of the bracket extends downwardly sufficiently adjacent the top rung of the ladder to prevent a user from unsafely standing on the top rung of the ladder. A plurality of accessory holders are removably mounted on the top edge of the walls of the housing and/or the bracket.

10 Claims, 6 Drawing Sheets

LADDER CADDY ASSEMBLY

BACKGROUND OF THE INVENTION

Field of the Invention

The present invention relates to ladder caddy devices and more particularly pertains to a new ladder caddy device for positioning on a ladder in a stable position and for holding a plurality of tools in such a manner that the tools are positioned generally adjacent to an upper end of a ladder. The ladder caddy also prevents the user from unsafely standing on the upper steps of the ladder.

Description of the Prior Art

The use of ladder caddy devices is known in the prior art. U.S. Pat. No. 5,782,314 describes a device that is positionable on a top of a ladder and is adapted for holding and organizing tools. Another type of ladder caddy device is U.S. Pat. No. 5,913,380 which includes another device which is attachable to a top of a ladder and which again may be used for holding and organizing tools. Still yet another such device is found in U.S. Pat. No. 5,967,259.

U.S. Pat. No. 7,032,711 discloses a two-piece pivotal accessory tray for a stepladder that fits over the top step of a ladder. This accessory tray is more complicated to manufacture than the present invention, and is not configured to prevent the user from unsafely standing on the upper rung of the ladder.

U.S. Pat. No. 5,865,409 discloses a bracket support for mounting a utility basket on a ladder. This device lacks the stability of the present invention, and also does not prevent the user from standing on the upper rung of the ladder. U.S. Pat. No. 6,564,941 discloses a tool and material holder configured to go over the top step of a ladder. This device is not made of a single piece of material, and specifically allows, rather than prevents, the user to stand on the upper rung of the ladder.

While these devices fulfill their respective, particular objectives and requirements, the need remains for a device that receives a ladder in such a manner that the device is not dependent on the size of the top end of the ladder. This will allow the device to be used on a plurality of ladders. The device should include a plurality of different detachable tool engaging members for holding, supporting and organizing a wide range of tools in a position such that the tools are within easy reach of the user.

The present invention meets the needs presented above by generally comprising a housing that has a bottom wall, a first side wall, a second side wall, a front wall and a rear wall. The rear wall is angled outwardly away from the bottom wall so that an angle between the bottom wall and the rear wall is between 100 degrees and 120 degrees, or other suitable angle. A bracket is attached to the housing and extends away from the rear wall. The bracket has a rear support wall that extends downward for a distance substantially equal to the downward extent of the front and rear walls of the housing. A plurality of removable accessory holding brackets are removably attached to the walls of the housing for holding tools and other accessories within easy reach of the user on the ladder. The bracket is adapted for removably coupling the housing to a ladder.

There has thus been outlined above, rather broadly, the more important features of the invention such that the detailed description thereof that follows may be better understood, and that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is a side view of an accessory holster adapted to be removably attached to the ladder caddy of FIG. 1 and to hold a drill, screw gun, or the like.

DESCRIPTION OF THE ILLUSTRATED EMBODIMENT

Figure 1:
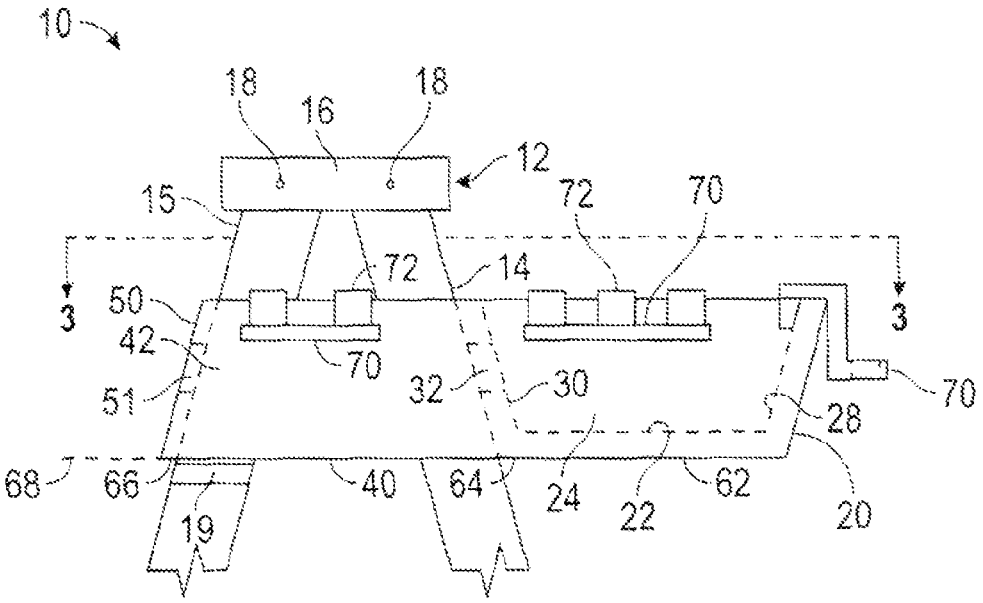
FIG. 1 is a side in-use view of a ladder caddy assembly mounted on a ladder and supporting a plurality of removable accessory holders, according to the present invention.

With reference to the drawings, and in particular to FIGS. 1 through 5, a new ladder caddy device embodying the principles and concepts of the present invention is generally designated by the reference numeral 10.

The ladder caddy assembly 10 generally comprises an assembly that may be removably mounted on a folding ladder 12 at a position straddling the front leg 14 and rear leg 15 of the ladder 12, and below the top step or platform 16 of the ladder 12. The legs 14 and 15 are pivotally attached to top step 16 at respective pivot points 18. The ladder 12 has a top rung 19 secured to rear leg 15. Most, if not all ladders display a warning label stating that it is unsafe to stand on the top rung 19. The assembly 10 includes a housing 20 that has a bottom wall 22, a first side wall 24, a second side wall 26 (FIG. 3), a front wall 28 and a rear wall 30. The rear wall 30 is angled upwardly and outwardly away from the bottom wall 22 so that an angle between the bottom wall 22 and the rear wall 30 is between 100 degrees and 120 degrees, or any other suitable angle. The rear wall 30 has an aperture 32 extending there through for the purpose of manually lifting the assembly 10 for placement over, and removal from, top platform 16 of the ladder 12.

Figure 3:
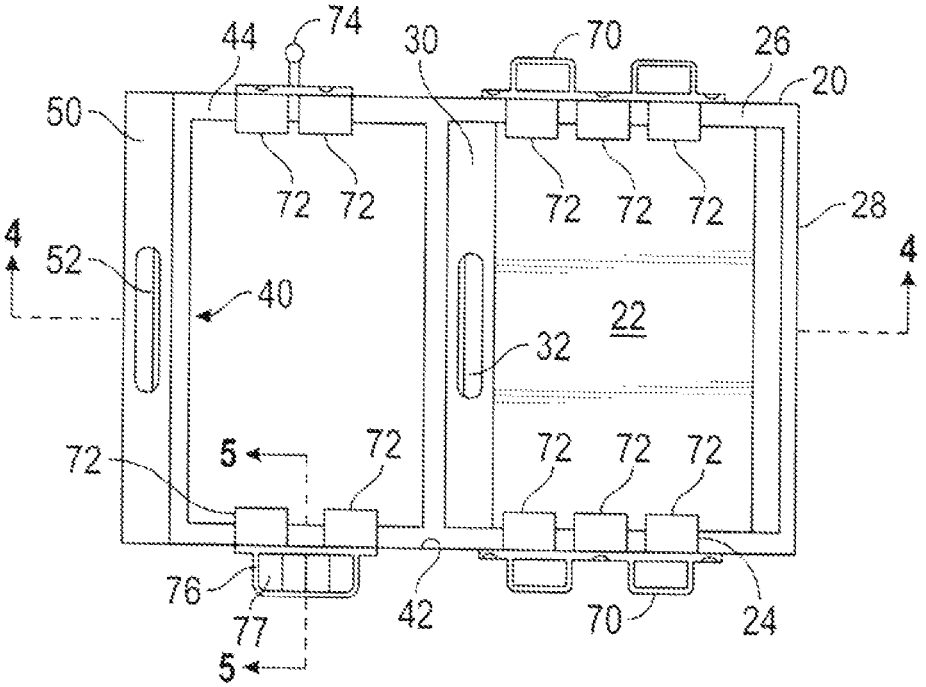
FIG. 3 is a top view of the ladder caddy of the present invention taken along line 3-3 of FIG. 1.
Figure 4:
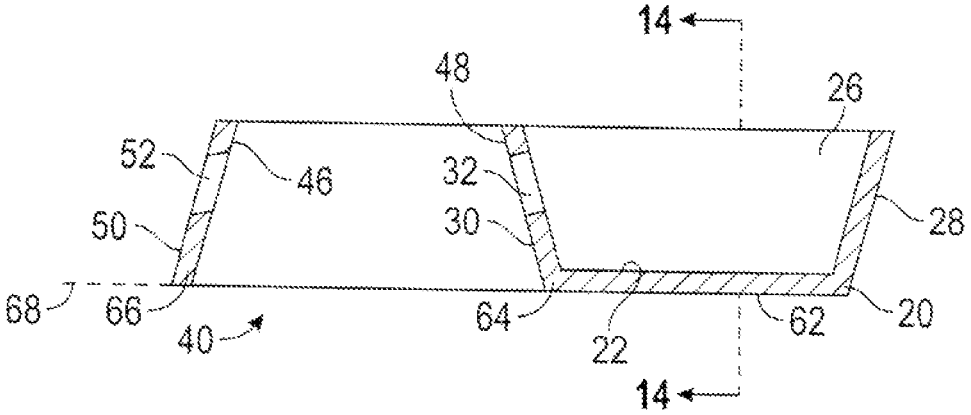
FIG. 4 is a cross-sectional view taken along line 4-4 of FIG. 3 of the present invention.

A bracket portion 40 is attached to the housing 20 and extends laterally away from the rear wall 30. The bracket portion 40 is adapted for removably mounting the housing 20 to the ladder 12. The bracket 40 includes a first side panel 42 and second side panel 44 (FIG. 3), each having a first outer end 46 and a second inner end 48 (FIG. 4). A slanted support wall 50 is attached to and extends between the first outer ends 46 of the first and second panels 42, 44. Each of the second ends 48 of the second panels 43,44 is attached to, and may form an integral part of, the housing 20 at a juncture of the rear wall 30 and one of the first 24 and second 26 side walls (FIG. 3). The first panel 42 lies in a plane orientated parallel and aligned with the first side wall 24 of the housing. The second panel 44 lies a plane orientated parallel to and is aligned with the second side wall 26 of the housing. A tapered opening for receiving legs 14 and 15 of the ladder 12 is defined between the oppositely tapered rear wall 30 and the tapered support wall 50. The support wall 50 lies in a plane orientated at an angle between 60 degrees and 80 degrees with respect to a plane of the bottom wall 22. The rear wall 30 and support wall 60 both extend downward in the same vertical direction a distance the same as the vertical dimension of the caddy assembly 12, as seen in FIG. 1. The angles of the rear 30 and support 50 walls allow these walls to abut the legs 14 and 15 of the ladder 12 over a relatively large area of the leg sections.

The support wall 50 has an aperture 52 extending there through. The apertures 32, 52 in the support 50 and rear 30 walls act as handles. A width from the first panel 42 to the second panel 44 is generally between 14 inches and 16 inches, and a distance between the support wall 50 and the rear wall 52 is generally between 6 inches and 12 inches.

Figure 2:
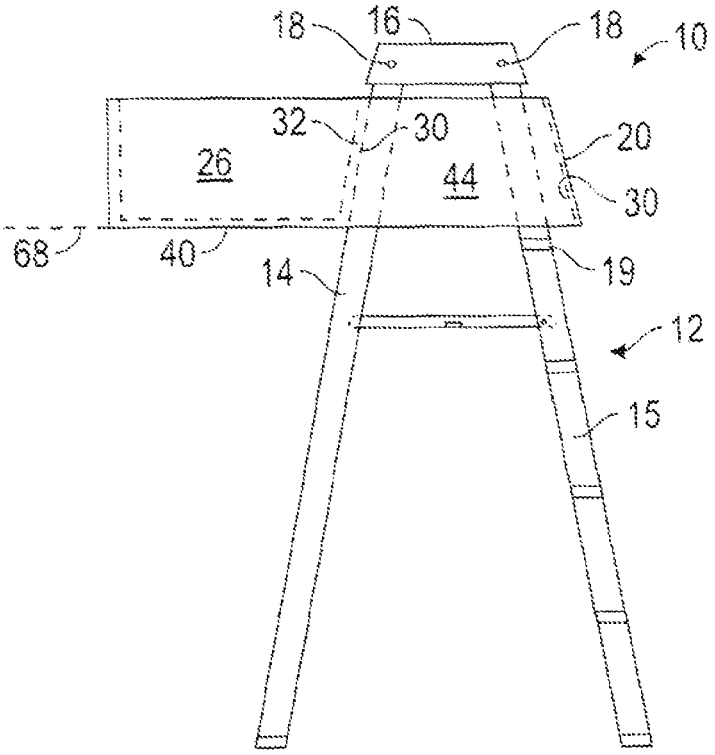
FIG. 2 is an opposite side view of the ladder caddy assembly of FIG. 1, showing the caddy without the removable accessory holders shown in FIG. 1, and showing the full height of the ladder upon which the caddy is mounted.

An important safety feature of the present invention is to prevent a user from standing on top rung 19 of ladder 12. The structure of ladder caddy assembly 10 is specifically designed and constructed to prevent a user from standing on top rung 19 when the ladder caddy assembly is mounted over top platform 16 of ladder 12, and when tapered rear wall 30 and tapered support wall 50 engage legs 14 and 15 of ladder 12, respectively. The bottom surface 62 (FIG. 4) of wall 22, and the lower edges 64, 66 (FIG. 4) of walls 30 and 50 of bracket portion 40 of caddy assembly 10 all lie in a common plane, defined by the line 68. When ladder caddy assembly 10 is placed over top platform 16 of ladder 12, and is positioned as shown in FIGS. 1 and 2, support wall 50 extends in a downward direction towards plane 68 and close to top rung 19 such that the downward extent of support wall 50 provides a small gap between the support wall 50 and top rung 19, which small gap prevents a user from inserting his/her feet between the bottom of support wall 50 and rung 19. In this manner, the user is prevented from standing on top rung 19 for safety reasons.

In an embodiment of the invention, a plurality of tool holders, pouches, accessory trays, or the like are inserted into or removably attached to the upper edges of housing portion 20 of ladder caddy 10. As seen in FIGS. 1 and 3, a pair of tool-holding brackets 70 include inverted substantially U-shaped mounting flanges 72. The mounting flanges 72 are adapted to extend over the top edges of walls 24 and 26 of housing portion 20, or over the side panels 42, 44 of bracket 40, such that the tool holding brackets 70 are removably attached to the housing portion 20 and/or the bracket 40. The user can insert tools or other items through or into the brackets 70 for easy access to the tools when working on the ladder.

Figure 5:
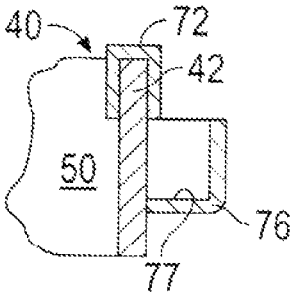
FIG. 5 is a cross-sectional view taken along line 5-5 of FIG. 3 of the present invention.
Figure 6:
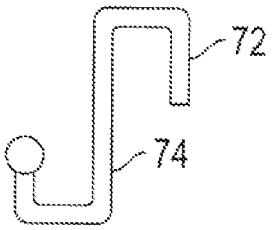
FIG. 6 is a side view of an accessory holder adapted to be removably attached to the ladder caddy of FIG. 1 and hold a towel.

As seen in FIGS. 3 and 6, a detachable post assembly 74 having a pair of substantially U-shaped mounting flanges 72 is removably mounted on the top of wall 44 of bracket portion 40. The post assembly 74 can be used to hold flexible items such as rags, cloths or tool belts. Also, as seen in FIGS. 3 and 5, a pocket 76 having a pair of U-shaped mounting flanges 72 is removably mounted to the top of wall 42 of bracket portion 40. The pocket 76 has a bottom surface 77 adapted to hold small items such as brushes, small tools, fasteners, and the like.

Figure 7:
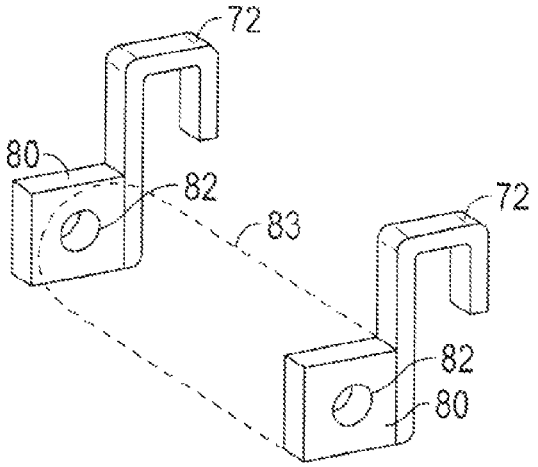
FIG. 7 shows a pair of accessory holders adapted to be removably attached to the ladder caddy of FIG. 1 for holding a rotating roll of paper towels.
Figure 8:
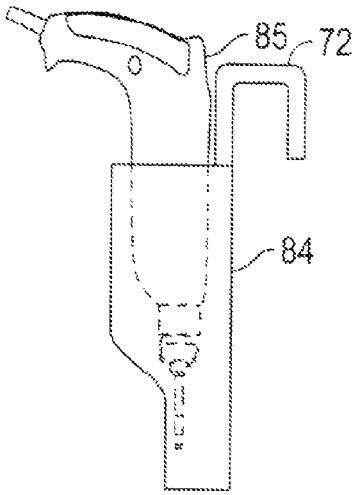

The upper edges or rims of front wall 28 and side walls 24, 26 of housing 20 are adapted to support one or a plurality of additional removably mounted accessory and tool holders or holsters as shown in FIGS. 1, 3 and 5-14. In each of FIGS. 6-14, substantially U-shaped mounting flanges 72 are shown attached to a variety of accessory holders that can each be removably mounted to the upper edges of ladder caddy 10. In FIG. 7, a pair of opposed roller mount surfaces 80 having protuberances 82 are attached to respective mounting flanges 72 for the purpose of supporting a roll of paper towels 83 on ladder caddy 10 within the reach of the user. FIG. 8 shows a drill or screw gun holster 84 attached to a mounting flange 72, where holster 84 is adapted to removably support a drill or screw gun 85 or similarly shaped device.

Figure 9:
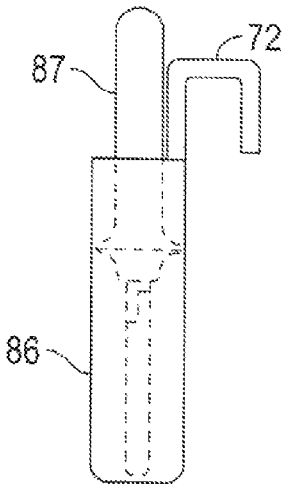
FIG. 9 is a side view of an accessory holster adapted to be removably attached to the ladder caddy of FIG. 1 for holding a pair of pliers.
Figure 10:
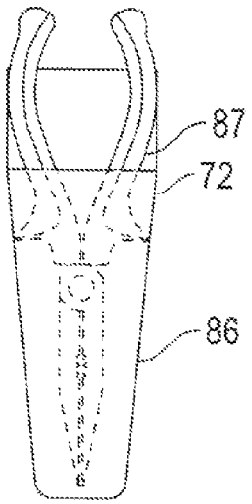
FIG. 10 is a front view of the pliers holster of FIG. 9.
Figure 11:
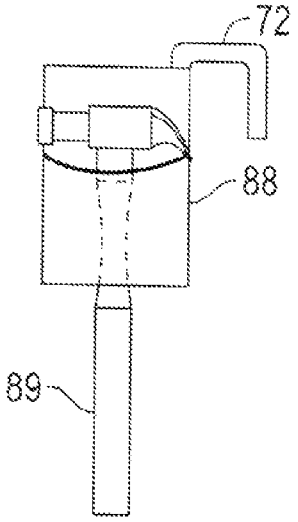
FIG. 11 is a perspective view of an accessory holster adapted to be removably attached to the ladder caddy of FIG. 1 and hold a hammer.
Figure 12:
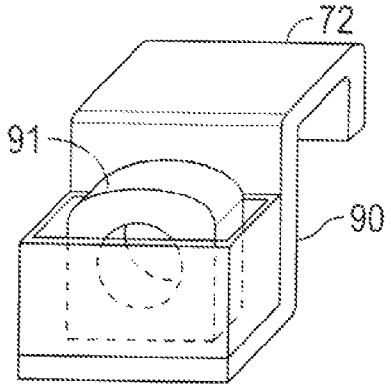
FIG. 12 is a perspective view of an accessory holder adapted to be removably attached to the ladder caddy of FIG. 1 to hold a tape measure.

FIGS. 9 and 10 illustrate a pliers or shears holster 86 attached to a mounting flange 72, where holster 86 is adapted to removably support a pair of pliers, scissors, shears 87, or other similar tool. FIG. 11 shows a pocket type hammer holder 88 attached to a mounting flange 72, and adapted to hold a hammer or mallet 89 or similar tool. FIG. 12 illustrates a tape measure pocket 90 attached to a mounting flange 72, where pocket 90 is adapted to hold a tape measure or other similar size or shaped device.

Figure 13:
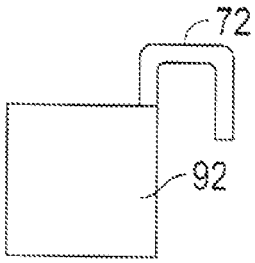
FIG. 13 is a side view of an accessory holder adapted to be removably attached to the ladder caddy of FIG. 1 to hold a paint can and/or one or more brushes.
Figure 14:
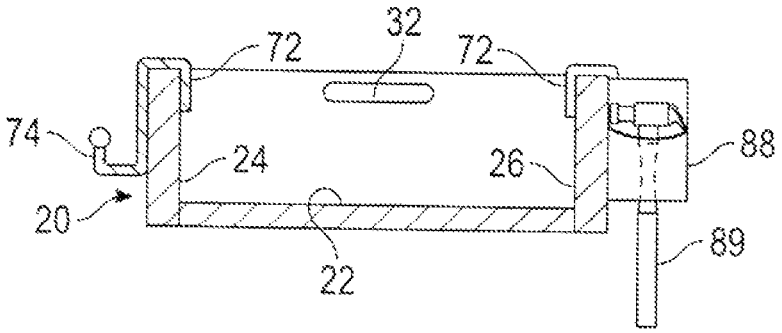
FIG. 14 is a cross-sectional view of the housing portion of the ladder caddy of FIGS. 1 and 3, taken along line 14-14 in FIG. 4, showing the towel hook of FIG. 6 and the hammer holder of FIG. 11 removably mounted on opposite side walls of the housing portion.

FIG. 13 shows a paint can or brush holder 92 attached to mounting flange 72. Holder 92 is larger than holder 90 of FIG. 12, for example, and is sized and strong enough to support a full can of paint and several paint brushes (not shown). FIG. 14 is a frontal cross-sectional view of housing portion 20 (FIG. 4) showing post assembly 74 removably mounted on side wall 24 of housing portion 20, and a pocket type hammer holder 88 (FIG. 11) removably mounted on side wall 26 of housing portion 20. In accordance with the teachings of the present invention, any of the accessories shown in FIGS. 6 through 13 may be removably mounted on side walls 24, 26 and/or front wall 28 of housing portion 20 as desired by the user of ladder caddy 10. The accessory holders may also be removably attached to side panels 42 and/or 44 of bracket 40, if desired.

Figure 15:
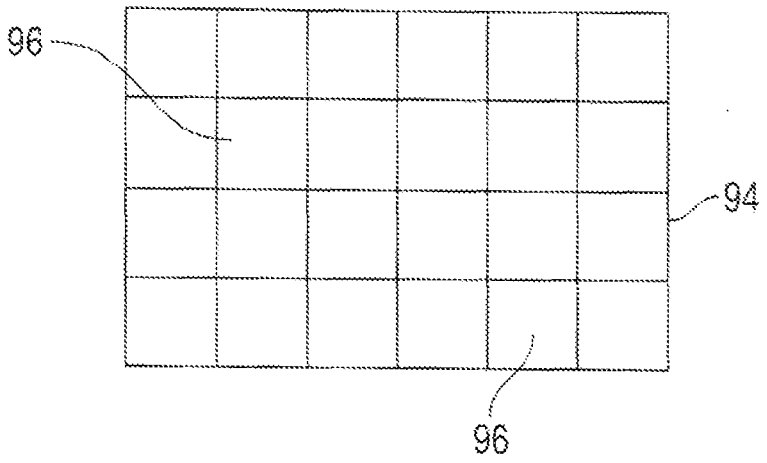
FIG. 15 is a top plan view of a compartmentalized tray having small compartments, the tray to be removably inserted into the housing portion of the ladder caddy of FIG. 1.

FIG. 15 illustrates a compartmentalized tray 94 having a flat bottom and a plurality of relatively small sized compartments 96 for holding small objects such as screws, nuts, bolts, nails or similarly sized articles. The outside dimensions of tray 94 are such that the tray can be easily inserted into and removed from the housing portion 20. When inserted, tray 94 rests over bottom wall 22 (FIG. 4).

Figure 16:
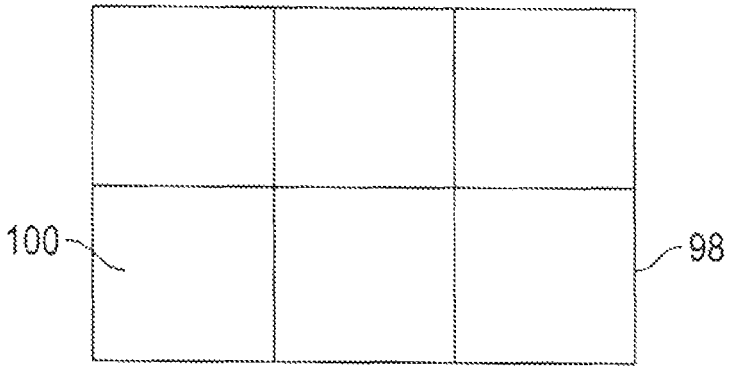
FIG. 16 is a top plan view of a compartmentalized tray having large compartments, the tray to be removably inserted into the housing portion of the ladder caddy of FIG. 1.

FIG. 16 is a compartmentalized tray 98 similar to that shown in FIG. 15 having substantially the same outside dimensions. The compartments 100 in tray 98 are larger than compartments 96 of tray 94. Tray 98 is adapted to be removably placed in housing portions 20 to hold larger objects and tools within reach of the user of ladder caddy 10.

Figure 17:
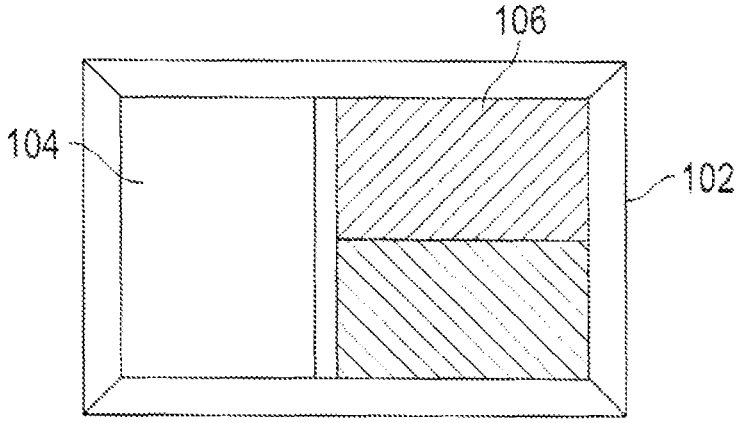
FIG. 17 is a top plan view of a paint tray sized to be removably inserted into the housing portion of the ladder caddy of FIG. 1.

FIG. 17 is a paint tray 102, also sized to be removably inserted into housing portion 20. Paint tray 102 includes a paint holding portion 104, and a ribbed portion 106 for applying the paint over the entire surface of a paint roller applicator (not shown).

Figure 18:
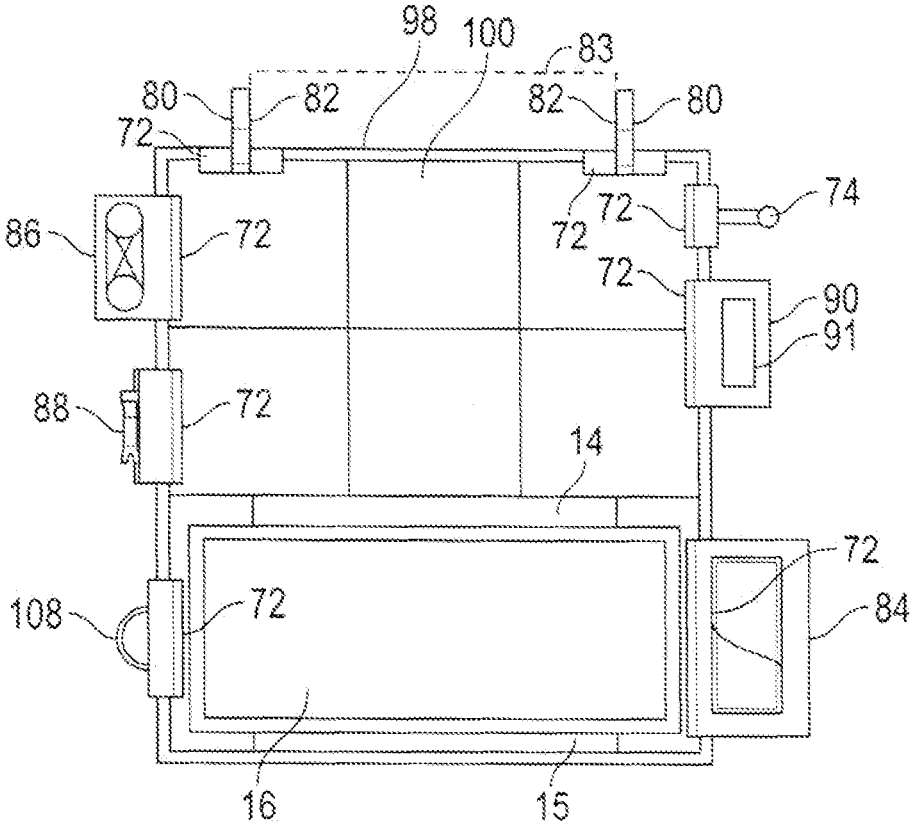
FIG. 18 is a top view of the ladder caddy and accessory holders of FIG. 1 placed over a ladder.

FIG. 18 is a top view of ladder caddy 10 placed over the top 16 of ladder 12, illustrating several accessory and tool holders removably supported by the ladder 12. The illustrated accessories include towel holder 74 and paper towel holder mounts 80, pliers holster 86, pocket type hammer holder 88, drill or screw gun holster 84, tape measure pocket 90, and semi-circular tool holder 108, each removably attached to the upper edges or surfaces of ladder caddy 10 by means of respective mounting flanges 72.

In use, the housing portion 20 is removably mounted over the top of the ladder 12 for supporting a plurality of maintenance or other items as shown in FIGS. 1, 2, and 18. The legs 14, 15 of the ladder 12 support the housing portion 20 in a horizontal orientation due to the opposed angles of the rear wall 30 and support wall 50.

The mounted housing portion 20 comes to rest just above the top rung 19 of ladder 12 (FIG. 1), thus also allowing the top step 16 to be used as a support for an item such as a pail, tool box, or the like. As seen in FIG. 1, the support wall 50 extends vertically downward a sufficient distance to prevent the user from unsafely standing on the upper step or steps of the ladder. In the illustrated embodiment of FIG. 1, the bottom surface 62 of wall 22 and the lower edges 64, 66 of walls 30 and 50 all lie in a single plane 68, thus preventing a user from placing his/her feet on top rung 19 of ladder 12 in the small gap formed between wall 50 and rung 19. Thus, the surface area of support wall 50, in addition to affording stability to the assembly 10 and housing 20, also provides a safety feature by preventing the user from standing on the top ladder rung 19 that is nearly or fully hidden beneath the support wall 50 when the assembly 10 is mounted on ladder 12.

With respect to the above description, it is to be realized that the optimum dimensional relationships for the parts of the invention, to include variations in size, materials, shape, form, function and manner of operation, assembly and use, are deemed readily apparent to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described and accordingly, all suitable modifications and equivalents may be resorted to, falling within the scope of the invention.

What is claimed:

1. A tool caddy assembly for being removably mounted to a folding ladder, the folding ladder including a pair of angled leg sections pivotally coupled to a top step of the folding ladder, the folding ladder also including a top rung positioned in a first horizontal plane below the top step, the assembly comprising:

a housing having a plurality of walls joined together to form said housing;

said plurality of walls including a rear wall extending upward at a first angle from a bottom wall of said housing, said bottom wall extending in a second horizontal plane;

a bracket attached to said housing, said bracket extending horizontally away from said rear wall, said bracket adapted to removably mount said housing to the pair of angled leg sections of said folding ladder;

said bracket having a plurality of walls, including a tapered outer support wall that extends upwardly at a second angle, said rear wall of said housing and said tapered outer support wall of said bracket forming a tapered opening extending along the entire vertical length between said rear wall of said housing and said tapered outer support wall of said bracket, said tapered opening adapted to receive and engage the angled leg sections of the folding ladder when the angled leg sections are inserted through upper and lower portions of the tapered opening of the bracket of the tool caddy assembly;

said outer support wall of said bracket having a lower edge that extends along said second plane;

said outer support wall adapted to extend downward when said caddy assembly is mounted on said folding ladder through said tapered opening and provide a gap between said top rung of said folding ladder and said lower edge of said outer support wall, said gap being too small to allow a user to insert the user's feet between the lower edge of the outer support wall and the top rung of the folding ladder.

2. The tool caddy assembly of claim 1, wherein said rear wall of said housing has a gripping aperture extending therethrough.

3. The tool caddy assembly of claim 1 wherein:

said plurality of walls of said bracket include first and second side panels each having outer and inner ends and a top edge, said outer support wall attached to and extending between said outer ends of said first and second side panels;

each of said inner ends of said side panels attached to opposite ends of said rear wall of said housing at a juncture of said rear wall and opposed side walls of said housing.

4. The tool caddy assembly of claim 3 wherein:

said rear wall of said housing and said outer support wall of said bracket are upwardly angled toward each other.

5. The tool caddy assembly of claim 1, wherein:

said plurality of walls of said housing includes first and second opposed side walls and a front wall, each of said side walls and said front wall having a top edge, each top edge adapted to removably attach at least one accessory support to the top edges of each of said side walls and front wall.

6. The tool caddy assembly of claim 5, wherein:

each of said at least one accessory support includes a substantially inverted U-shaped flange, each said flange adapted to removably extend over the top edge of said side walls or said front wall to removably and selectively attach said accessory support to said top edge of said side walls and said front walls of said housing.

7. The tool caddy assembly of claim 5, wherein:

said at least one accessory support is selected from the group consisting of a tool holding bracket, a post assembly, an item-holding pocket, paper towel holder comprising a pair of opposed roller mount surfaces, a drill or screw gun holster, a pliers or shears holster, pocket-type hammer holder, taper measure pocket, and paint can and brush holder.

8. A tool caddy assembly for being removably mounted on a folding ladder, the folding ladder including a pair of angled leg sections pivotally coupled to a top step of the folding ladder, the folding ladder also including a top rung positioned in a first horizontal plane below the top step, the assembly comprising:

a housing having a plurality of walls joined together to form said housing;

said plurality of walls including a rear wall extending upward at a first angle from a bottom wall of said housing, said bottom wall extending in a second horizontal plane;

a bracket attached to said housing, said bracket extending horizontally away from said rear wall, said bracket adapted to removably mount said housing to said folding ladder;

said bracket having a plurality of walls, including a tapered outer support wall that extends upwardly at a second angle, said rear wall of said housing and said tapered outer support wall of said bracket adapted to engage the angled leg sections of the folding ladder when the tool caddy assembly is mounted on said ladder;

said outer support wall of said bracket having a lower edge that extends along said second plane;

said outer support wall adapted to extend downward when said caddy assembly is mounted on said folding ladder and provide a gap between said top rung of said folding ladder and said lower edge of said outer support wall, said gap being too small to allow a user to insert the user's feet between the lower edge of the outer support wall and the top rung of the folding ladder;

a holding tray removably inserted in said housing, said holding tray supported by the bottom wall of said housing.

9. The tool caddy assembly of claim 8, wherein:

said holding tray is selected from the group consisting of a compartmentalized holding tray and a paint holding tray.

10. The tool caddy assembly of claim 1 wherein:

at least one accessory support is fixed to the outer surface of one of said housing and said bracket.

* * * * *